US005697179A

United States Patent [19]

Vanmoor

[11] Patent Number: 5,697,179

[45] Date of Patent: Dec. 16, 1997

[54] CARTRIDGE CLIP ASSEMBLY

[76] Inventor: Arthur Vanmoor, 18761 W. Dixie Hwy., North Miami Beach, Fla. 33180

[21] Appl. No.: 691,130

[22] Filed: Aug. 1, 1996

[30] Foreign Application Priority Data

Feb. 28, 1996 [NL] Netherlands ..... 100 2468

[51] Int. Cl.[6] ..... F41A 9/67

[52] U.S. Cl. ..... 42/87; 42/50

[58] Field of Search ..... 42/50, 7, 18, 22, 42/49.02, 87, 88, 90

[56] References Cited

U.S. PATENT DOCUMENTS

| | | | |
|---|---|---|---|
| 1,797,951 | 3/1931 | Gaidos | 42/50 |
| 3,443,334 | 5/1969 | Ardolino | 42/50 |
| 3,603,020 | 9/1971 | Wiese | 42/50 |
| 4,107,862 | 8/1978 | Sofinowski, III | 42/50 |
| 4,514,922 | 5/1985 | Farrar et al. | 42/7 |
| 4,516,346 | 5/1985 | Farrar et al. | 42/50 |
| 4,831,761 | 5/1989 | Kulakow | 42/50 |
| 4,995,179 | 2/1991 | Switzer | 42/50 |
| 5,081,778 | 1/1992 | Switzer | 42/50 |
| 5,113,605 | 5/1992 | Kim | 42/50 |
| 5,291,679 | 3/1994 | Wollack et al. | 42/50 |
| 5,309,660 | 5/1994 | Blackamore | 42/106 |

FOREIGN PATENT DOCUMENTS

| | | | |
|---|---|---|---|
| 747658 | 10/1944 | Germany | 42/50 |

*Primary Examiner*—Stephen M. Johnson
*Attorney, Agent, or Firm*—Herbert L. Lerner; Laurence A. Greenberg

[57] ABSTRACT

A cartridge clip assembly includes an exterior housing having a cavity for storing a multiplicity of bullets. Inserted into the exterior housing is an interior housing. The interior housing has an interior cavity for receiving the bullets. There is a compression spring disposed in the interior housing for providing a compression spring force on the bullets when the interior housing is inserted into the exterior housing. There is a latching and releasing mechanism for securing the interior housing in the exterior housing and for releasing the interior housing from the exterior housing.

10 Claims, 3 Drawing Sheets

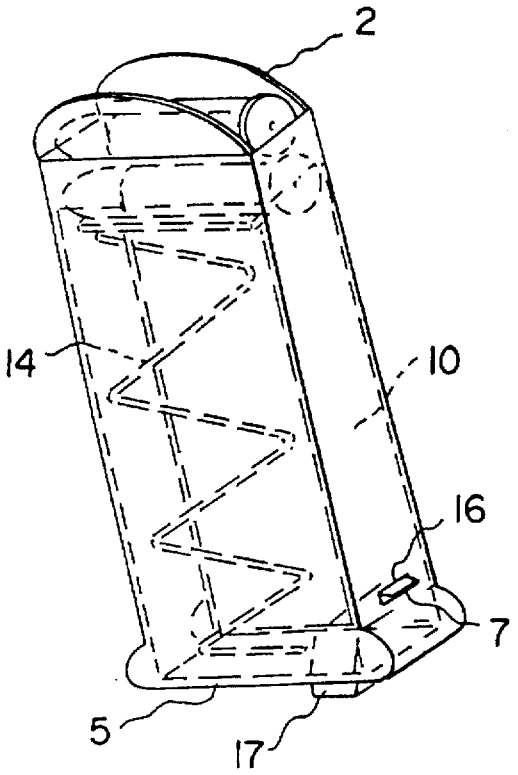
FIG. 6
FIG. 7
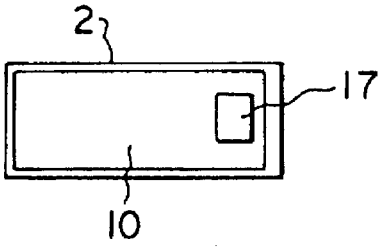
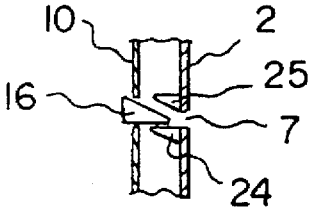
FIG. 8

CARTRIDGE CLIP ASSEMBLY

BACKGROUND OF THE INVENTION

1. Field of the Invention

The invention relates to an improved cartridge clip assembly used in firearms, and more particularly, to a cartridge clip assembly that allows for the rapid loading or unloading of cartridge shells.

2. Description of the Related Art

The typical cartridge clip carries a series of bullets, and is adapted to feed those bullets one at a time and in succession to the firing chamber of the gun. The basic cartridge clip structure includes a cartridge with a bullet ejection end and a closed end in combination with a compression spring positioned within the cartridge. A substantial compression spring force must be available in a cartridge clip to ensure the sequential movement of the bullets within the cartridge.

The conventional method of loading cartridge shells or bullets into the cartridge clip of a firearm involves the progressive compression of the spring in the cartridge with the loading of each successive bullet. As more bullets are added to the cartridge, the resistance in the compression spring increases making it harder to load the next bullet. The process of loading the bullets, one-at-a-time and against successive bullets requires considerable dexterity and force. Unaided, the loading of the cartridge in the prescribed manner is difficult, time consuming and can lead to the gun jamming if the bullets are misaligned in the cartridge loading process.

In order to overcome the foregoing problems in loading bullets into a cartridge, various loading aids have been developed as well as adaptations to the cartridge itself. While loading aid devices have made the cartridge loading process easier, the focus has been on modifying the cartridge so as to remove the need for loading aid devices.

U.S. Pat. No. 4,995,179 to Switzer discloses an example of a modification to the cartridge assembly. In the Switzer embodiment, the compression spring tension is reduced by permitting the compression spring to expand beyond its interior restricted length. This is accomplished by an opening on the bottom of the cartridge which allows the compression spring to expand to the exterior of the cartridge. The expanded compression spring reduces the amount of compression spring force that must be overcome when loading the cartridge clip. However, the Switzer embodiment does not totally eliminate the compression spring force which means the bullets still have to be loaded one at a time and the loading of the last few bullets must overcome a significant compression spring force.

U.S. Pat. No. 5,309,660 to Blackamore discloses another modification to the cartridge assembly. In Blackamore, the cartridge assembly includes a key insertable through a slot in an end panel of the cartridge into a spring elevator contained within the cartridge. By exerting a force on the key inserted into the spring elevator, one can lower the spring in the cartridge and lock the spring in the lowered position with the key. That allows the loading of the cartridge without having to overcome an opposing force from the compression spring. That embodiment, like the invention of the instant application, allows the rapid loading of the cartridge without the need to overcome an opposing force exerted by a compression spring. However, the methods used to accomplish that objective are more complicated and costly than in the instant application.

In Blackamore, there are the additional components of a key, chain, key housing, and an enlarged spring elevator that must be built into the cartridge clip assembly. The key and chain dangle from the bottom of the cartridge and those components can be an annoyance to the firearm owner.

SUMMARY OF THE INVENTION

It is accordingly an object of the invention to provide a cartridge clip assembly, which overcomes the hereinmentioned disadvantages of the heretofore-known devices and methods of this general type, and which makes it quicker and easier to load and unload a cartridge clip assembly.

In the invention of the instant application, there is no compression spring force that must be over come when loading bullets into the cartridge clip. The bullets are rapidly loaded into an exterior housing which does not have a compression spring component. After the bullets have been loaded, an interior housing, containing a compression spring, is combined with the exterior housing to complete the loading process.

In addition, the invention of the instant application does not require the extra hardware found in the cartridge clip of the Blackamore embodiment and other prior art embodiments necessary to reduce or remove the compression spring force. Therefore, the invention of the instant applicant is less expensive to manufacture, easier to operate, and does not have the inconvenience of extra components dangling at the bottom of the cartridge clip potentially interfering with the operation of the firearm.

With the foregoing and other objects in view there is provided, in accordance with the invention, a cartridge clip assembly, comprising an exterior housing having a cavity for storing a multiplicity of bullets; an interior housing for insertion into the exterior housing and the interior housing has an interior cavity for receiving the bullets; a compression spring is disposed in the interior housing for providing a compression spring force on the bullets with the interior housing inserted into the exterior housing; and a latching and releasing mechanism for securing the interior housing in the exterior housing and for releasing the interior housing from the exterior housing.

In accordance with an added feature of the invention, the exterior housing has a rectangular cross section, an open top end, and an open bottom end.

In accordance with another feature of the invention, the interior housing has a rectangular cross section, a bottom end and a top end having an opening formed therein.

In accordance with an additional feature of the invention, the compression spring has a first and a second end, the first end of the compression spring is connected to the bottom end of the interior housing and the second end extends upward in the interior housing.

In accordance with an concomitant feature of the invention, the rectangular cross section of the interior housing has an angled lip for funneling the bullets into the interior housing.

In accordance with an added feature of the invention, there is a spring plate connected to the second end of the compression spring for providing a support surface for the bullets.

In accordance with another feature of the invention, the exterior housing has a bullet stop plate for preventing the bullets from entering deeper into the exterior housing.

In accordance with an additional feature of the invention, the latching and releasing mechanism has a latch plate mounted on the exterior housing, and a latch release mechanism mounted on the interior housing.

In accordance with an concomitant feature of the invention, the latch release mechanism has an engaging latch for locking with the latch plate.

In accordance with an added feature of the invention, the latch plate has an upper plate and a lower plate for securing the engaging latch.

An interesting feature of the invention of the instant applicant is the ability to remove only the interior housing of the cartridge clip. The firearm owner can load the bullets directly into the exterior housing contained within the firearm. After loading the desired number of bullets, the cartridge clip is closed by inserting the interior housing into the exterior housing still contained within the firearm.

Other characteristic features of the invention are set forth in the appended claims.

Although the invention is illustrated and described herein as embodied in a cartridge clip assembly, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 6 is a perspective view of the assembled cartridge clip with the interior housing residing in the exterior housing;

FIG. 7 is an end-elevational view of the latch release mechanism mounted on the interior housing which in turn is inserted in the exterior housing; and FIG. 8 is an enlarged, fragmentary, side-elevational view of the engaging latch secured to the latch plate.

DESCRIPTION OF THE PREFERRED EMBODIMENTS

Figures 1, 2:
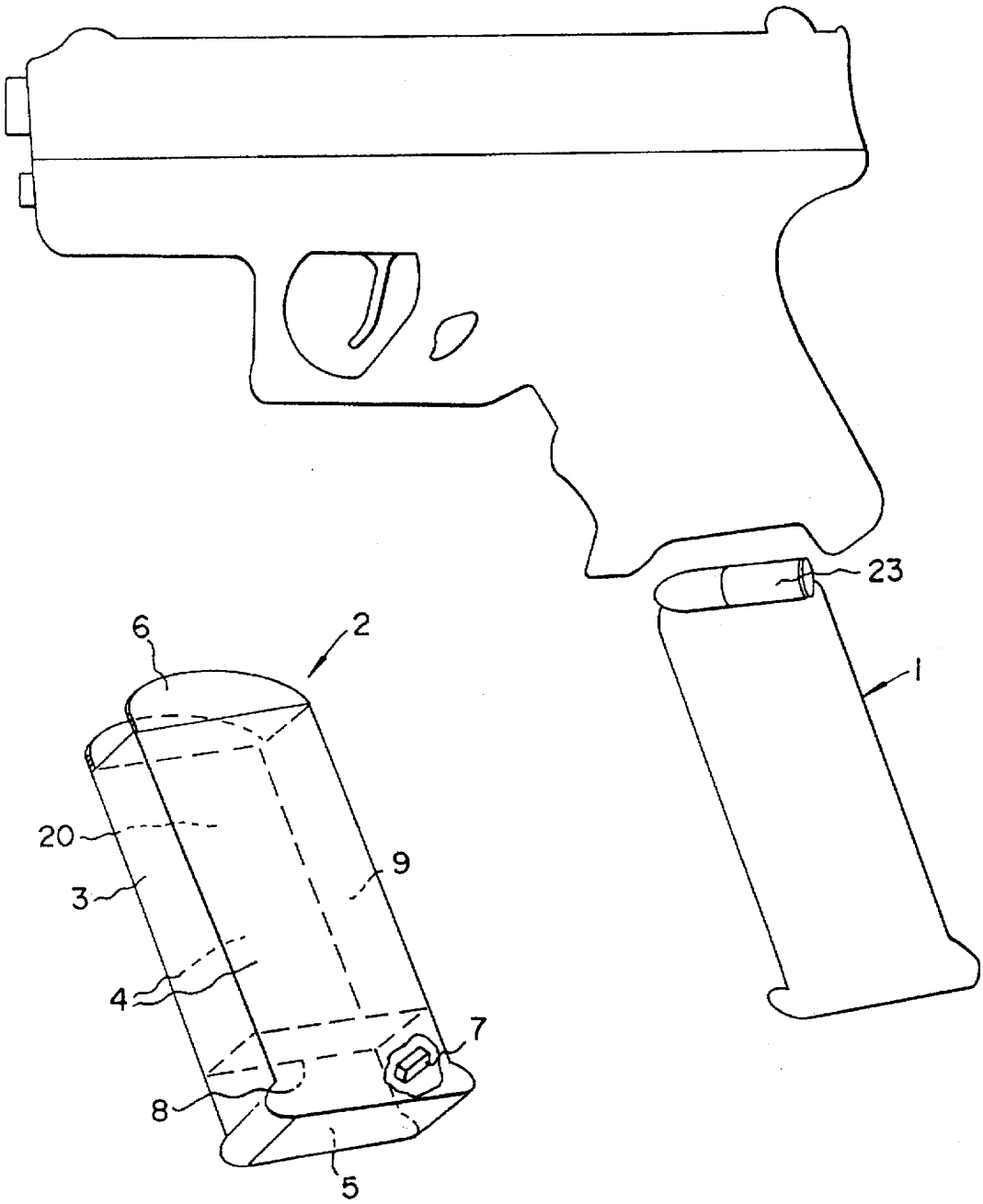
FIG. 1 is an exploded diagramatic, side-elevation view of a firearm and a cartridge clip assembly according to the invention.
FIG. 2 is a perspective view of an exterior housing of the cartridge clip assembly.

Referring now to the figures of the drawing in detail and first, particularly, to FIG. 1 thereof, there is shown a cartridge clip assembly 1, housing a multiplicity of bullets 23, ready for loading into a firearm.

FIG. 2 shows an exterior housing 2 of the cartridge clip assembly 1 shown in FIG. 1. The exterior housing 2 has a left exterior side wall 3, a right exterior side wall 9, a first and second exterior wall 4, an exterior bottom end 5 and an exterior top end 6. Both the exterior bottom end 5 and the exterior top end 6 have openings. The first and second exterior wall 4, the left exterior side wall 3, and the right exterior side wall 9 make up the rectangular cross section of the exterior housing 2. The exterior housing 2 has a cavity 20 for holding the multiplicity of bullets. Bullets can be rapidly loaded into the exterior housing 2 through the opening in the exterior top end 6. Since the exterior housing 2 does not contain a compression force to oppose the loading process, the loading of bullets is accomplished quickly and easily.

Within the exterior housing 2 is a bullet stop plate 8 and a latch plate 7. The bullet stop plate 8 is dimensioned to prevent a bullet from entering any deeper into the exterior housing 2. The latch plate 7 is mounted on the inside of the right exterior side wall 9.

Figure 3:
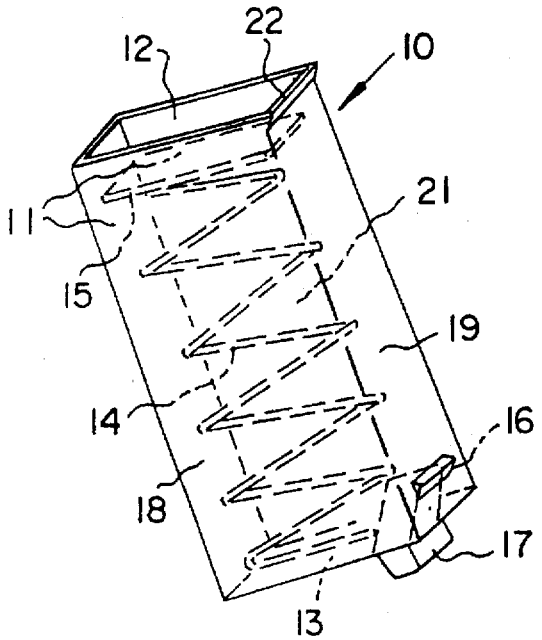
FIG. 3 is a perspective view of an interior housing of the cartridge clip assembly.

FIG. 3 shows an interior housing 10 of the cartridge clip assembly 1 shown in FIG. 1. The interior housing 10 has a first and second interior wall 11, a left interior side wall 18, a right interior side wall 19, an interior top end 12 and an interior bottom end 13. The interior housing 10 is dimensioned to fit inside of the exterior housing 2 shown in FIG. 2. The interior top end 12 has an opening to allow the interior housing 10 to slide into the exterior housing loaded with bullets. The right interior side wall 19 has an angled lip 22 to help funnel the bullets into the interior housing 10. The interior housing 10 has a cavity 21 for holding bullets. The first and second interior wall 11, the left interior side wall 18, and the right interior side wall 19 make up the rectangular cross section of the interior housing 10.

Sticking out of the perimeter of the interior housing 10 is a latch release mechanism 17 and an engaging latch 16. The engaging latch 16 is dimensioned to secure to the top of the latch plate 7 shown in FIG. 2. When the engaging latch 16 is secured to the latch plate 7, the interior housing 10 and the exterior housing 2 shown in FIG. 2 are locked together. When pressed, the latch releasing mechanism 17 will pull the engaging latch 16 into the interior of the interior housing 10 disengaging the interior housing 10 from the exterior housing 2. When pressed again, the latch release mechanism 17 will push the engaging latch 16 to the exterior of the interior housing 10.

Within the interior housing 10 is a compression spring 14 and a spring plate 15. The compression spring 14 is attached to the interior bottom end 13 at a first end and to the spring plate 15 at a second end. The spring plate 15, reacting to a compression force applied by the compression spring 14, provides a loading mechanism necessary to transport bullets into a firing chamber of the firearm.

Figure 4:
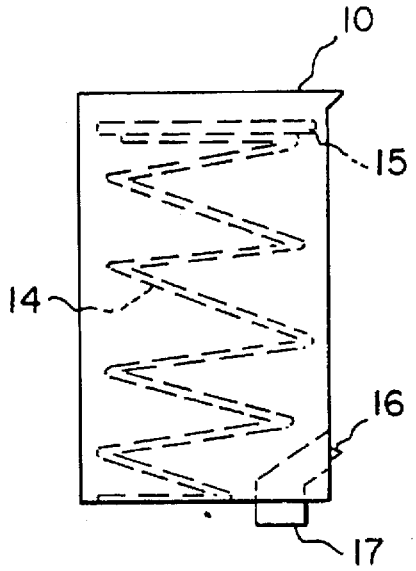
FIG. 4 is a side-elevation view of the interior housing highlighting an engaging latch and a latch release mechanism.

FIG. 4 shows another view of the compression spring 14, the engaging latch 16 and the latch release mechanism 17 of the interior housing 10.

Figure 5:
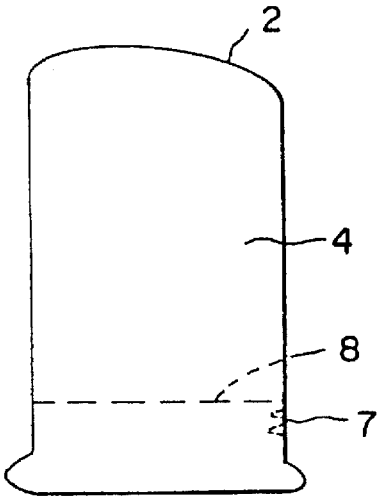
FIG. 5 is a side-elevation view of the exterior housing highlighting a latch plate.

FIG. 5 shows another view of the latch plate 7 and the bullet stop plate 8 contained within the exterior housing 2.

FIG. 6 is a view of the interior housing 10 contained within the exterior housing 2. The exterior bottom end 5 of the exterior housing hides the latch release mechanism 17.

FIG. 7 shows a view of the location of the latch release mechanism 17 located on the interior housing 10 when the interior housing 10 is inserted into the exterior housing 2.

FIG. 8 shows an enlarged view of the engaging latch 16, mounted in the interior housing 10, secured to the latch plate 7, mounted on the exterior housing 2. The engaging latch 16 and the latch plate 7 are shaped to allow the engaging latch 16 to slide by a lower plate 24 of the latch plate 7 when the interior housing 10 is inserted into the exterior housing 2. Once the engaging latch 16 slides by the lower plate 24 of the latch plate 7, it springs into a cavity created between the lower plate 24 and an upper plate 25 of the latch plate 7. The interior housing 10 is prevented from entering further into the exterior housing 2 by the upper plate 25 of the latch plate. The engaging latch 16 is held in place until it is pulled backed by the latch engaging mechanism 17 shown in FIG. 4. The combination of the latch plate 7, the engaging latch 16 and the latch release mechanism 17 make up the latching and releasing mechanism of the cartridge clip assembly 1. FIG. 8 shows just one example of many latching mechanisms that could be utilized to secure the interior housing 10 to the exterior housing 2.

I claim:

1. A cartridge clip assembly, comprising;

an exterior housing having a cavity for storing a multiplicity of bullets and said exterior housing being formed with an opening through which the bullets are insertable into said cavity;

an interior housing for insertion into said exterior housing and over the bullets stored in said exterior housing, said interior housing having an interior cavity for receiving the bullets while said interior housing is being inserted into said exterior housing;

a compression spring disposed in said interior housing for providing a compression spring force on the bullets with said interior housing inserted into said exterior housing; and a latching and releasing mechanism for securing said interior housing in said exterior housing and for releasing said interior housing from said exterior housing.

2. The cartridge clip assembly according to claim 1, wherein said exterior housing has a rectangular cross section, an open top end, and an open bottom end.

3. The cartridge clip assembly according to claim 1, wherein said interior housing has a rectangular cross section, a bottom end and a top end having an opening formed therein.

4. The cartridge clip assembly according to claim 3, wherein said compression spring has a first and a second end, said first end of said compression spring is connected to said bottom end of said interior housing and said second end extends upward in said interior housing.

5. The cartridge clip assembly according to claim 4, including a spring plate being connected to said second end of said compression spring for providing a support surface for the bullets.

6. The cartridge clip assembly according to claim 3, wherein said rectangular cross section of said interior housing has an angled lip for funneling the bullets into said interior housing.

7. The cartridge clip assembly according to claim 1, wherein said latching and releasing mechanism has a latch plate mounted on said exterior housing, and a latch release mechanism mounted on said interior housing.

8. The cartridge clip assembly according to claim 7, wherein said latch release mechanism has an engaging latch for locking with said latch plate.

9. The cartridge clip assembly according to claim 8, wherein said latch plate has an upper plate and a lower plate for securing said engaging latch.

10. The cartridge clip assembly according to claim 1, wherein said exterior housing has a bullet stop plate for preventing the bullets from entering deeper into said exterior housing prior to insertion of said interior housing.

* * * * *